US012680291B1

(12) United States Patent
Alrubaidi

(10) Patent No.: US 12,680,291 B1
(45) Date of Patent: Jul. 14, 2026

(54) MOMENT CONNECTIONS FOR STRUCTURAL STEEL FRAMES AND CONSTRUCTION METHODS THEREOF

(71) Applicant: KING SAUD UNIVERSITY, Riyadh (SA)

(72) Inventor: Mohammed Abdulkhaleq Alrubaidi, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 19/373,602

(22) Filed: Oct. 29, 2025

(51) Int. Cl.
*E04B 1/24* (2006.01)
*E04H 9/02* (2006.01)

(52) U.S. Cl.
CPC ..... *E04B 1/2403* (2013.01); *E04H 9/021* (2013.01); *E04B 2001/2409* (2013.01); *E04B 2001/2415* (2013.01); *E04B 2001/2418* (2013.01); *E04B 2001/2421* (2013.01); *E04B 2001/2448* (2013.01); *E04H 9/024* (2013.01)

(58) Field of Classification Search
CPC ..... E04H 9/021; E04H 9/024; E04B 1/2403; E04B 2001/2409; E04B 2001/2415; E04B 2001/2418; E04B 2001/2421; E04B 2001/2448
See application file for complete search history.

(56) References Cited

U.S. PATENT DOCUMENTS 5,688,069 A 11/1997 Hoshino
5,827,006 A 10/1998 Hoshino
6,837,016 B2 1/2005 Simmons et al.
7,497,054 B2 3/2009 Takeuchi et al.
7,941,985 B2 5/2011 Simmons
(Continued)

FOREIGN PATENT DOCUMENTS

CN 107489201 A * 12/2017 ..... E04H 9/024
CN 209837295 U 12/2019
(Continued)

OTHER PUBLICATIONS

Alrubaidi, Mohammed, et al. "Investigation of different steel intermediate moment frame connections under column-loss scenario." Thin-Walled Structures 154 (2020): 106875.
(Continued)

*Primary Examiner* — Phi D A
(74) *Attorney, Agent, or Firm* — Nath, Goldberg & Meyer; Joshua B. Goldberg

(57) ABSTRACT

An assembly for a moment connection between a steel beam and a steel column includes a bracket and a clamp. The bracket and the clamp can be made of steel and are configured to be slidably connected to one another. The bracket is configured to be affixed to the column. The clamp is configured to be affixed to an end of the beam. The bracket has an elongated body. The clamp includes a hollow structural member extending laterally to the length direction of the beam. The clamp also includes first to third bars extending from a vertical sidewall of the hollow structural member in the length direction of the beam, toward the bracket. The first to third bars define a space between them that houses the bracket inside. The first to third bars surround the bracket in a way that forms a moment connection between the clamp and the bracket.

8 Claims, 11 Drawing Sheets

(56) References Cited

U.S. PATENT DOCUMENTS

| | | | | |
|---|---|---|---|---|
| 8,051,626 | B2 * | 11/2011 | Ubinana Felix | E04G 11/52 446/120 |
| 8,782,994 | B1 | 7/2014 | Simmons | |
| 8,789,325 | B2 * | 7/2014 | Verhaeghe | E04B 2/705 52/561 |
| 10,815,655 | B2 | 10/2020 | Febbo | |
| 11,773,593 | B1 * | 10/2023 | Abbas | E04C 3/06 52/854 |
| 12,091,879 | B1 | 9/2024 | Abbas et al. | |
| 12,359,421 | B1 * | 7/2025 | Alrubaidi | E04B 1/2403 |
| 12,404,685 | B1 * | 9/2025 | Erickson | E04G 1/04 |
| 2006/0165482 | A1 | 7/2006 | Olberding | |
| 2018/0266099 | A1 * | 9/2018 | Lippert | E04B 1/2403 |
| 2019/0257071 | A1 * | 8/2019 | Green | E04B 1/2403 |
| 2020/0232203 | A1 * | 7/2020 | Weber | E04C 3/06 |
| 2025/0092708 | A1 * | 3/2025 | Kim | E04H 9/021 |

FOREIGN PATENT DOCUMENTS

| | | | | |
|---|---|---|---|---|
| CN | 112854450 | A * | 5/2021 | E04B 1/24 |
| CN | 115075389 | A * | 9/2022 | E04H 9/024 |
| CN | 117905166 | A * | 4/2024 | G06F 30/23 |
| GB | 293264 | A * | 7/1928 | E04B 1/2403 |
| GB | 589154 | A * | 6/1947 | E04B 1/2403 |
| GB | 1532990 | A * | 11/1978 | F16B 7/044 |
| GB | 2431973 | B * | 4/2009 | E04B 1/2403 |
| KR | 101879034 | B1 * | 7/2018 | E04C 3/02 |
| KR | 102005848 | B1 * | 10/2019 | E04H 12/10 |

OTHER PUBLICATIONS

Hamburger, Ronald O., and James O. Malley. Seismic design of steel special moment frames. Maryland, USA: US Department of Commerce, National Institute of Standards and Technology, 2016.

* cited by examiner

MOMENT CONNECTIONS FOR STRUCTURAL STEEL FRAMES AND CONSTRUCTION METHODS THEREOF

TECHNICAL FIELD

The present disclosure relates to metal frames, and more particularly, to moment connections utilized in steel framed buildings, steel framed bridges, etc., and a method of constructing the same.

DISCUSSION OF THE RELATED ART

The frame of a steel building typically utilizes beams to transfer weight from each floor to the columns, and the columns transfer the weight to the ground. A moment connection is a strong type of connection between a beam and a column. However, moment connections are costly to manufacture and install in the field. In addition, moment connections can be time consuming to install.

SUMMARY

The present subject matter relates to various assemblies of parts for providing strong moment connections in metallic frames such as steel framed buildings, steel framed bridges, etc. Each assembly of moment connection parts of the present subject matter can be manufactured and installed for a low cost.

Particularly, each moment connection assembly of the present subject matter includes two parts that are configured to be slidably engaged with one another in the field to simplify and facilitate the erection of a frame, thereby reducing the cost of erection and reducing the time span in which the frame is built.

The two parts are a bracket and a clamp. The bracket is configured to be welded or otherwise fixedly attached to a steel column. The clamp is configured to be welded or otherwise fixedly attached to the end of a steel beam.

The bracket can take the shape of a vertically-extending steel block (or steel bar). The clamp has a vertically-extending cutout (or space) configured to receive the bracket inside. The beam can be connected to a column by raising the beam over the elevation of the bracket and lowering the beam downwardly such that the cutout of the clamp can be lowered to sit onto the bracket (and cover the bracket).

The clamp may include a top wall (alternatively referred to as a "third bar" in the specification below). The top wall of the clamp rests on top of the bracket, supporting the weight of the beam and preventing the beam from being further lowered down.

One or more fasteners (e.g., bolts) can be used to strengthen the moment connection provided by an assembly of parts of the present subject matter. However, the number of fasteners used by an assembly of the present subject matter is far smaller than the number of bolts required by a conventional moment connection assembly since the slidable engagement between a bracket and a clamp of the present subject matter can, by itself, e.g., without bolts, provide a sufficiently strong moment connection between a beam and a column.

A conventional moment connection typically requires a large number of bolts to rigidly connect a beam to a column.

Since a large number of bolts requires a large amount of installation time in the field, and since this step is largely downscaled or can be eliminated altogether when using an assembly of the present subject matter, the teachings of this specification can reduce the amount of time required to install a moment connection in the field while providing for a strong connection between a beam and a column.

As such, the teachings of the present subject matter can be used to reduce the cost of labor required to erect a steel structure and to reduce the amount of time required to erect the structure.

BRIEF DESCRIPTION OF THE DRAWINGS

The above and other features of the present disclosure will become more apparent by describing in detail exemplary embodiments thereof in conjunction with the accompanying drawings, in which:

FIG. 2 is a cross-sectional view taken along line A-A of FIG. 1, which extends along the center of beams and along the center of the pair of moment connection assemblies that the beams are connected to;

FIG. 10 is a cross-sectional view of the moment connection assemblies of FIG. 7, taken along a line that extends along the center of beams and along the center of the moment connection assemblies that the beams are connected to;

FIG. 16 is a cross-sectional view of the moment connection assemblies of FIG. 11, taken along a line that extends along the center of beams and along the center of the moment connection assemblies that the beams are connected to;

DETAILED DESCRIPTION OF THE EMBODIMENTS

Figure 1:
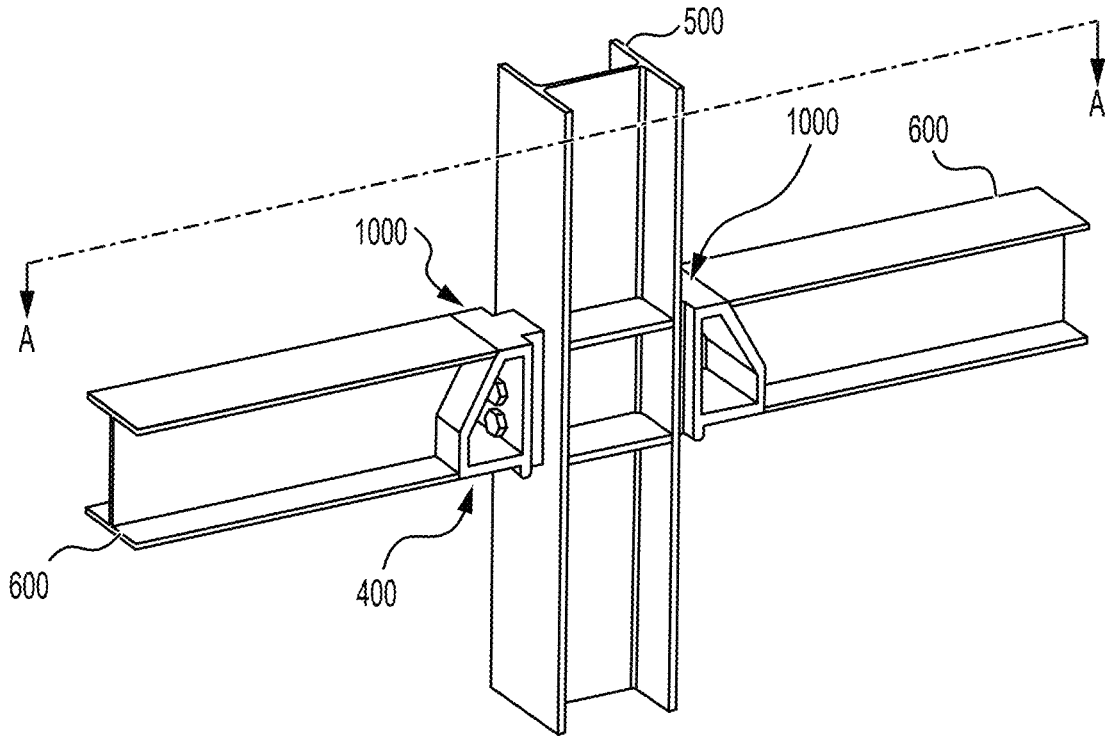
FIG. 1 is a perspective view illustrating a pair of moment connection assemblies in accordance with an embodiment of the subject matter.

Exemplary embodiments of the present disclosure will be described more fully hereinafter with reference to the accompanying drawings. The present disclosure may, however, be embodied in different forms and should not be construed as being limited to the embodiments set forth herein. Like reference numerals may refer to like elements throughout the specification. The sizes and/or proportions of the elements illustrated in the drawings may be exaggerated for clarity.

When an element is referred to as being disposed on another element, intervening elements may be disposed therebetween. In addition, elements, components, parts, etc., not described in detail with respect to a certain figure or embodiment may be assumed to be similar to or the same as corresponding elements, components, parts, etc., described in other parts of the specification.

Throughout the application, where compositions are described as having, including, or comprising specific components, or where processes are described as having, including, or comprising specific process steps, it is contemplated that compositions of the present teachings can also consist essentially of, or consist of, the recited components, and that the processes of the present teachings can also consist essentially of, or consist of, the recited process steps.

It is noted that, as used in this specification and the appended claims, the singular forms "a", "an", and "the" may include plural references unless the context clearly dictates otherwise.

In the application, where an element or component is said to be included in and/or selected from a list of recited elements or components, it should be understood that the element or component can be any one of the recited elements or components, or the element or component can be selected from a group consisting of two or more of the recited elements or components. Further, it should be understood that elements and/or features of a composition or a method described herein can be combined in a variety of ways without departing from the spirit and scope of the present teachings, whether explicit or implicit herein.

The use of the terms "include," "includes", "including," "have," "has," or "having" should be generally understood as open-ended and non-limiting unless specifically stated otherwise.

The use of the singular herein includes the plural (and vice versa) unless specifically stated otherwise. In addition, where the use of the term "about" is before a quantitative value, the present teachings also include the specific quantitative value itself, unless specifically stated otherwise. As used herein, the term "about" refers to a ±10% variation from the nominal value unless otherwise indicated or inferred.

The term "optional" or "optionally" means that the subsequently described event or circumstance may or may not occur, and that the description includes instances where said event or circumstance occurs and instances in which it does not.

Unless defined otherwise, all technical and scientific terms used herein have the same meaning as commonly understood to one of ordinary skill in the art to which the presently described subject matter pertains.

Where a range of values is provided, for example, concentration ranges, percentage ranges, or ratio ranges, it is understood that each intervening value, to the tenth of the unit of the lower limit, unless the context clearly dictates otherwise, between the upper and lower limit of that range and any other stated or intervening value in that stated range, is encompassed within the described subject matter. The upper and lower limits of these smaller ranges may independently be included in the smaller ranges, and such embodiments are also encompassed within the described subject matter, subject to any specifically excluded limit in the stated range. Where the stated range includes one or both of the limits, ranges excluding either or both of those included limits are also included in the described subject matter.

Figure 2:
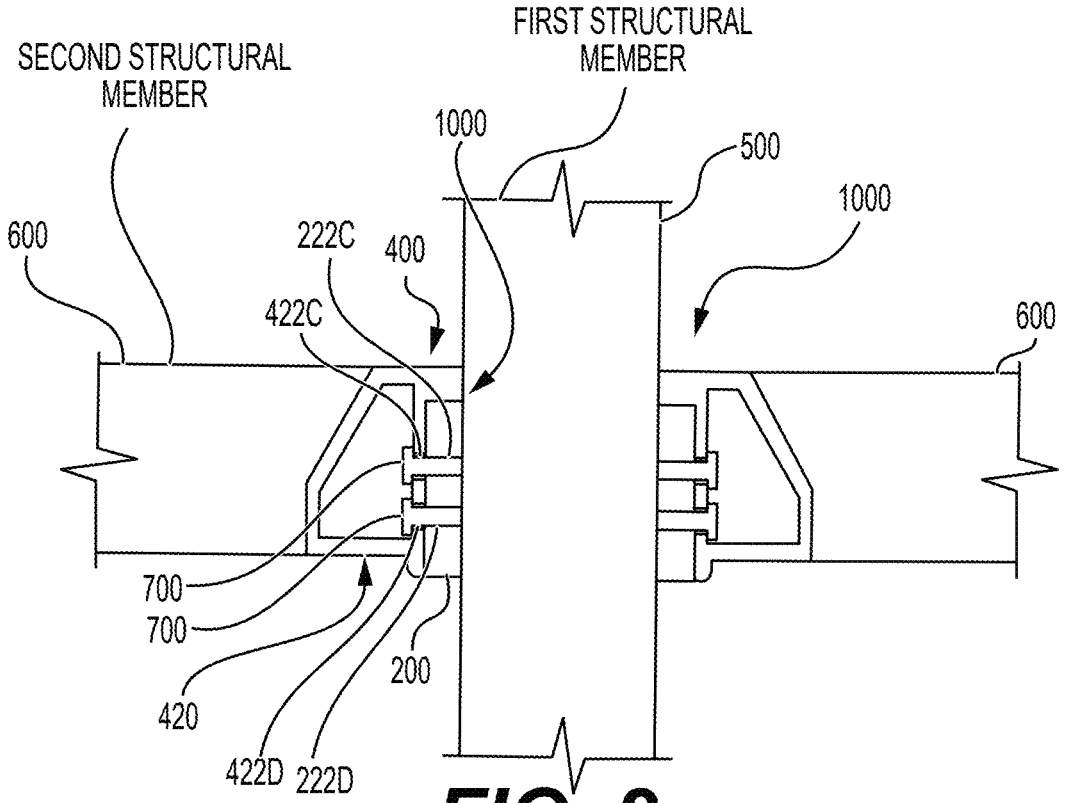
Figure 3:
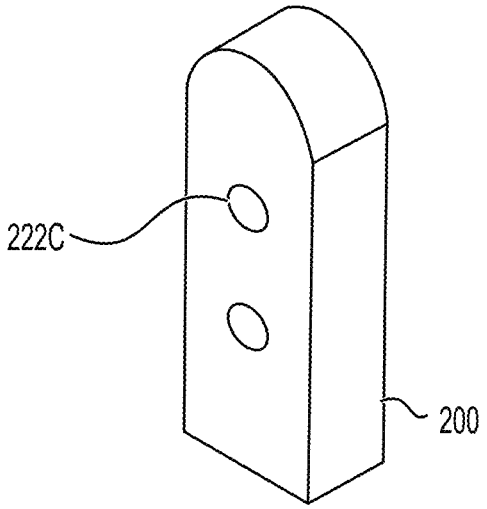
FIG. 3 is a perspective view illustrating a bracket included in each moment connection assembly of FIG. 1.
Figure 4:
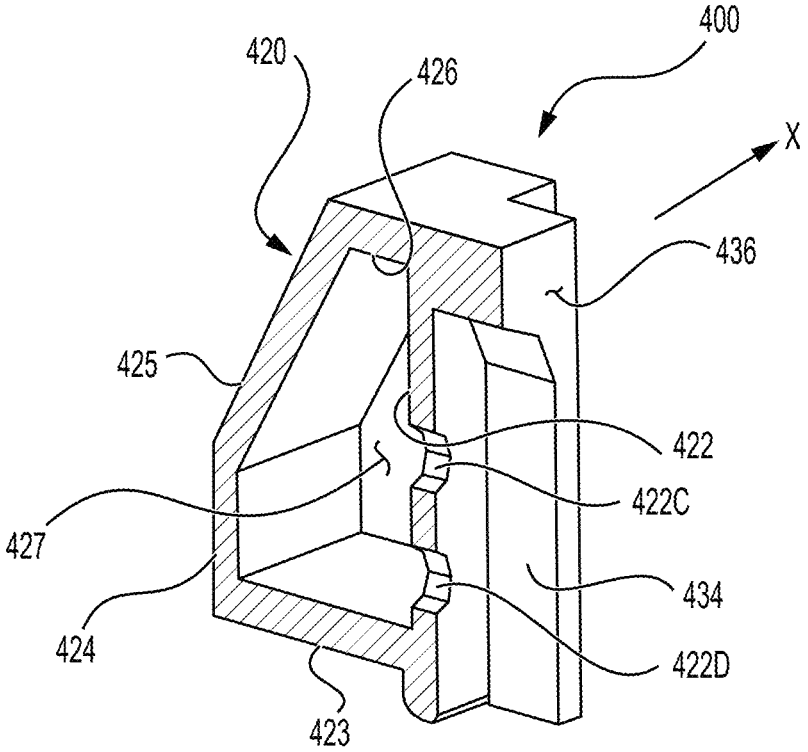
FIG. 4 is a perspective view illustrating a clamp included in each moment connection assembly of FIG. 1, cut vertically along its center.
Figure 5:
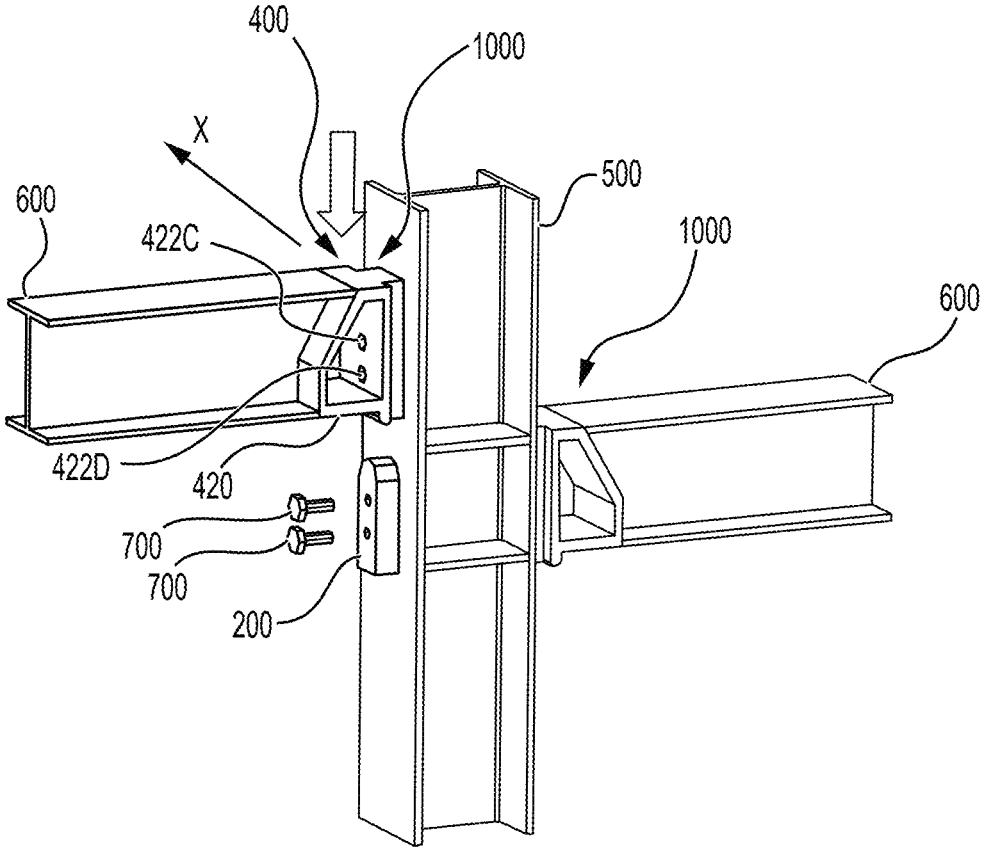
FIG. 5 is a first perspective view illustrating the left-hand side moment connection assembly of FIG. 1 during installation.

FIGS. 1-6 illustrate a moment connection assembly in accordance with an exemplary embodiment of the present subject matter. Specifically, FIGS. 1-2 and 5 illustrated a pair of moment connection assemblies 1000 of the present subject matter, each connecting a respective beam 600 with the same column 500.

Each moment connection assembly 1000 may be made of a metal. The column 500 and the beams 600 may each be made of a metal. The metal forming the moment connection assemblies 1000, the beams 600 and the column 500 may be, merely as an example, iron, aluminum, zinc, etc., so long as the metal is suitable for constructing the frame of a structure (e.g., the frame of a building, the frame of a bridge, etc., as the case may be). The metal forming the moment connection assemblies 1000, the beams 600 and the column 500 may also be an alloy, for example, steel (such as structural grade steel or structural grade stainless steel), brass, etc.

In certain embodiments, the metal forming each column 500 and each beam 600 may be the same. In other embodiments, the metal forming each column 500 and each beam 600 may be the same or different.

In an approach, the metal forming the moment connection assemblies 1000, the beams 600 and the column 500 is structural grade steel.

Since both moment connection assemblies 1000 of the structure of FIGS. 1-2 and 5 are the same as one another (but arranged in a mirror configuration relative to one another), the specification below will describe in detail the moment connection assembly 1000 arranged to the left-hand side of the structure illustrated in FIGS. 1-2 and 5 for brevity.

Referring to FIGS. 1-6, an assembly 1000 for a moment connection between first and second structural members 500, 600 includes a bracket 200 and a clamp 400.

The first structural member 500 is the column 500 and the second structural member 600 refers to the beam 600 to the left-hand side of the column 500. The term "first structural member 500" may be used interchangeably with the term "column 500" and the term "second structural member 600" may be used interchangeably with the term "beam 600."

The bracket 200 has an elongated body (e.g., a bar-shaped body) and is configured to be affixed to the first structural member 500. The bracket 200 may be connected to the first structural member 500 by welding, bolts, etc., enabling the bracket 200 to transmit a bending moment and shear and axial forces between the first structural member 500 and the clamp 400.

The clamp 400 is configured to be affixed to an end of the second structural member 600. The clamp 400 may be connected to the end of the second structural member 600 by welding, merely as an example, to enable the clamp 400 to transmit a bending moment and shear and axial forces between the second structural member 600 and the bracket 200.

Figure 6:
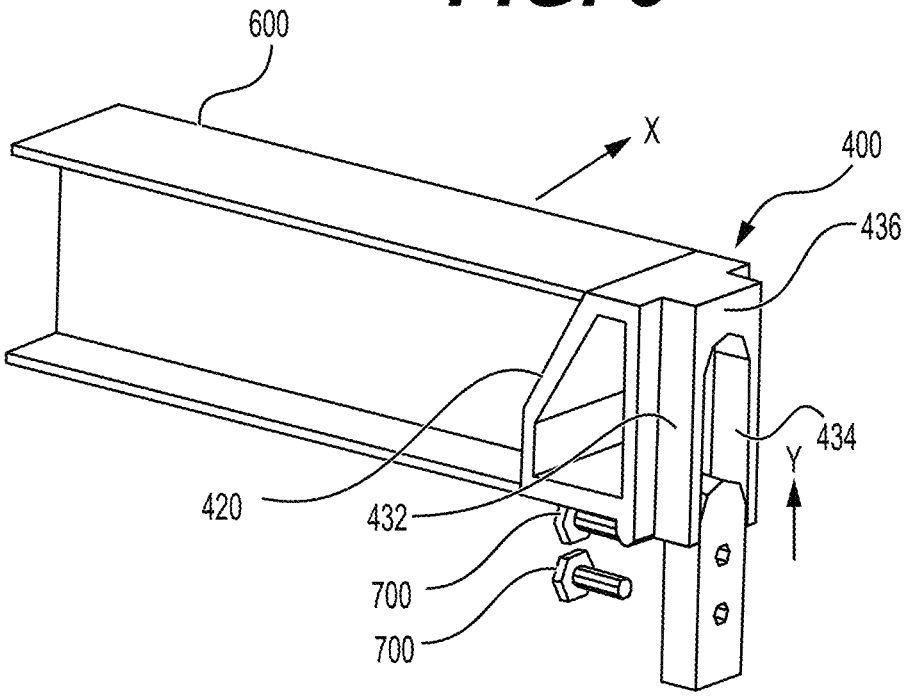
FIG. 6 is a second perspective view illustrating the left-hand side moment connection assembly of FIG. 1 during installation.

The clamp 400 includes a hollow structural member 420 extending in a first direction X (see FIGS. 4-6). The first direction X may extend laterally to the direction in which the second structural member 600 extends, for example, at about 90 degrees to the direction in which the second structural member 600 extends.

The hollow structural member 420 may have a polygonal shape (more specifically, a closed polygonal shape, as compared to an open polygonal shape having a slit or other opening extend along one of its sidewalls).

The hollow structural member 420 may include a plurality of sidewalls 422-426 (see FIG. 4). The sidewalls 422-426 (or first to fifth sidewalls 422-426) may each extend in the first direction X and may be connected to one another along their respective edges, forming (or defining) a cavity 427 between them. The cavity 427 extends in the first direction X.

The closed shape (e.g., closed pentagonal shape) of the hollow structural member 420 increases the rigidity of the moment connection assembly 1000 as a whole, and enables structural fastener(s) (e.g., bolt(s)) to be inserted in the cavity 427 to selectively connect the clamp 400 and the bracket 200 to one another.

The hollow structural member 420 is shown as being a pentagon merely as an example, but the present subject matter is not limited to this configuration. For example, the hollow structural member 420 may be formed to have fewer than five sidewalls or more than five sidewalls.

The hollow structural member 420 may also include first to third bars 432, 434, 436 (see FIG. 6) protruding from the face of the first sidewall 422 that faces (or is arranged proximate to) the bracket 200.

The first bar 432 protrudes from the first sidewall 422 and extends in a second direction Y that intersects the first direction X. The first bar 432 extends in the vertical direction when the assembly 1000 is aligned as shown in FIGS. 1-6.

The second bar 434 protrudes from the first sidewall 422 and extends in a second direction Y that intersects the first direction X. The second bar 434 is spaced apart from the first bar 432 in the first direction X. The first and second bars 432, 434 can extend in parallel to one another.

The third bar 436 protrudes from the first sidewall 422, and connects the first and second bars 432, 434 to one another. This way, the first to third bars 432, 434, 436 and the first sidewall 422 define a space between them that is configured to selectively receive the elongated body of the bracket 200 therealong to selectively connect the bracket 200 and the clamp 400 to one another.

The first sidewall 422 of the hollow structural member 420 may include a first cavity 422C (e.g., the upper cavity 422C illustrated in FIGS. 4-5). The elongated body of the bracket 200 may include a first cavity 222C (e.g., the upper cavity 222C illustrated in FIG. 3). The first cavity 422C of the first sidewall 422 and the first cavity 222C of the elongated body of the bracket 200 are configured to be aligned with one another when the elongated body of bracket 200 is selectively received in its space defined by the clamp 400, as illustrated in FIG. 2.

The assembly 1000 may include a first fastener 700 (e.g., the upper fastener illustrated in FIGS. 2 and 5). The first fastener 700 is configured to be engageably received in the first cavity 422C of the first sidewall 422 and in the first cavity 222C of the elongated body of the bracket 200 to connect the bracket 200 and the clamp 400 to one another. The first fastener 700 may be fed into the first cavities 422C, 222C via the cavity 427 of the hollow structural member 700.

The first fastener 700 may be a bolt. The bolt 700 may include threads extending along its outer surface. The first cavities 222C and 422C, respectively, may have threads matching the threads of the bolt 700. This way, the bolt 700 can be threadably connected to the bracket 200 and the clamp 400 to selectively and fixedly connect the bracket 200 and the clamp 400 to one another.

The first sidewall 422 of the hollow structural member 420 may further include a second cavity 422D spaced apart from the first cavity 422C. The elongated body of the bracket 200 may further include a second cavity 222D spaced apart from the first cavity 222C.

The second cavity 422D of the first sidewall 422 and the second cavity 222D of the elongated body of the bracket 220 are configured to be aligned with one another when the elongated body of bracket 220 is selectively received in its space defined by the clamp 400.

The assembly 1000 may also include a second fastener 700. The second fastener is configured to be engageably received in the second cavity 422D of the first sidewall 422 and in the second cavity 222D of the elongated body of the bracket 200 (via the cavity 427) to connect the bracket 200 and the clamp 400 to one another. The second fastener 700 may be the same as the first fastener 700, and the second cavities 422D, 222D, respectively, may have the same configuration as the first cavities 422C, 222C.

While the assembly 1000 is illustrated as including two fasteners 700, the present disclosure is not limited to this configuration. The assembly 1000 can alternatively be provided with one fastener 700 (and one set of matching cavities therefor in the bracket 200 and the clamp 400), or with more than three fasteners 700 (and a corresponding number of matching cavities in the bracket 200 and clamp 400).

The moment connection assembly 1000 can be quickly installed in the field by lowering the clamp 400 (with an end of the beam 600 connected to the clamp 400) on the bracket 200, as shown in the step-by-step installation views of FIGS. 5 and 6. When the clamp 400 is fully lowered onto the bracket 200, the third bar 436 rests on top of the bracket 200, thereby preventing the clamp 400 from being lowered any further, as more clearly shown in the cross-sectional view of FIG. 2. In this seated state (or fully lowered state), the first to third bars 432, 434, 436 can transfer a bending moment, shear and axial forces between the beam 600 and the column 500. The fastener(s) 700 can transfer a tensile axial force from the beam 600 to the column 500.

The ease of installation of the assembly 1000 in the field reduces the time required to construct the frame of a building, bridge, or other structure, as the case may be, and reduces the cost of erecting the structure.

Moment connection assemblies that share at least one feature/component with the assembly 1000 will be described below. For brevity purposes, the specification below may focus on the differences between the assembly 1000 and the particular assembly being described. Features, components, etc., of an assembly of the present subject matter that are not described in detail in the text below may be presumed to be the same as or similar to corresponding features, components, etc., of the assembly 1000.

For example, the assembly 1000A, described below in detail with reference to FIGS. 7-10, includes a protrusion (referred to as a "fourth bar" below) protruding from the third bar 436A. The assembly 1000A also includes a notch at the rear end of the top side of the bracket 200A (adjacent to the column 500A). The notch is configured to receive the protrusion (or fourth bar) therein to provide a secure connection between the bracket and the clamp of the assembly 1000A.

In more detail, and referring to FIGS. 7-10, a moment connection assembly 1000A includes a bracket 200A and a clamp 400A.

Figure 9:
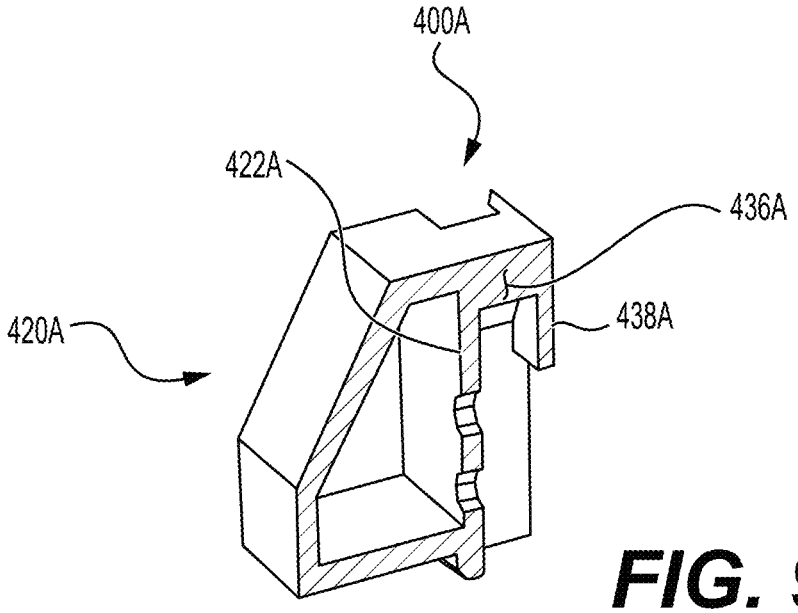
FIG. 9 is a perspective view illustrating a clamp included in each moment connection assembly of FIG. 7, cut vertically along its center.

Referring to FIG. 9, the clamp 400A includes a third bar 436A, which protrudes from the first sidewall 422A, similarly to the third bar 436 of the clamp 400. In addition, the clamp 400A includes a fourth bar 438A (see FIGS. 9-10) protruding (or extending) from the third bar 436A. The fourth bar 438A may extend in a different direction than the third bar 436A. As exemplarily illustrated in FIGS. 9-19, the third bar 436A may extend (or protrude) horizontally (toward the bracket 200A) from the first sidewall 422A of a hollow structural member 420A of the clamp 400A, and the fourth bar 438A may extend downwardly (vertically) from the distal end of the third bar 436A. Stated otherwise, the third and fourth bars 436A, 438A may extend in different directions that cross one another.

Figure 7:
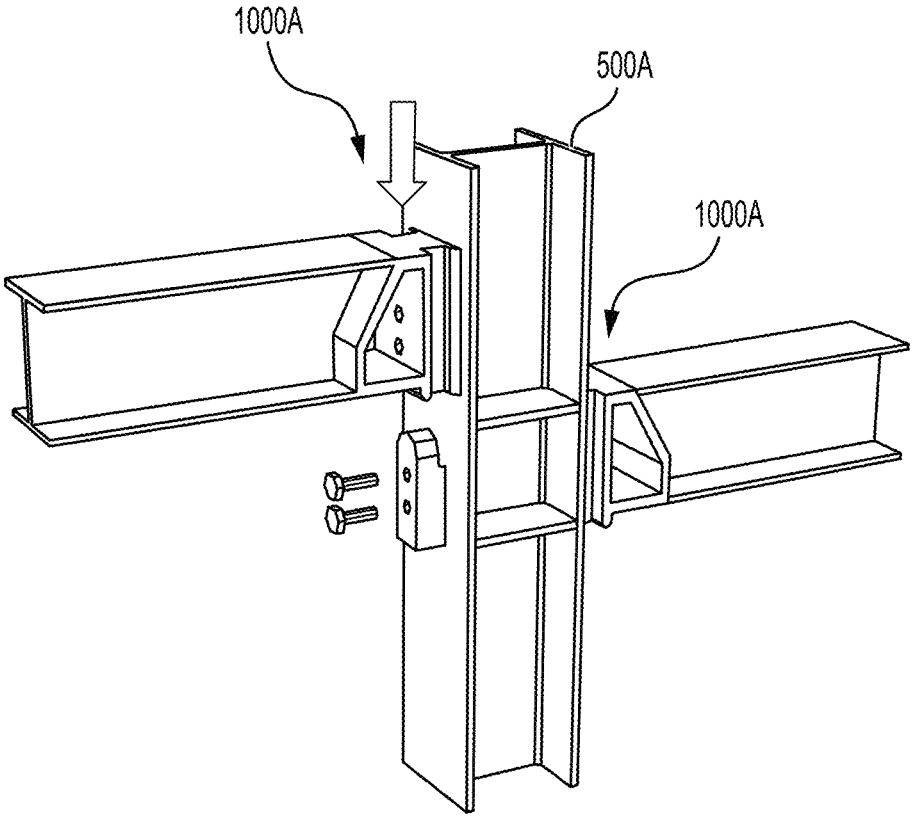
FIG. 7 is a perspective view illustrating a pair of moment connection assemblies in accordance with an embodiment of the subject matter.
Figure 8:
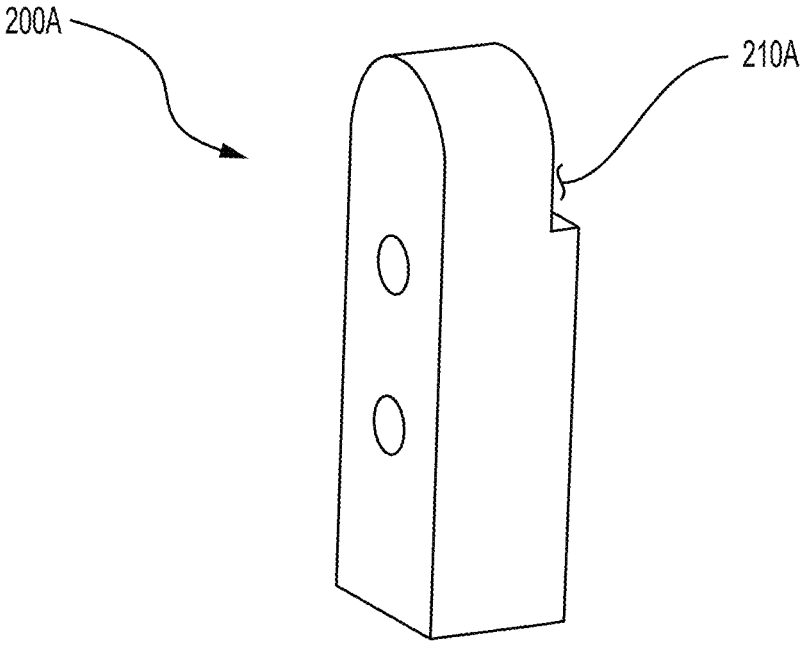
FIG. 8 is a perspective view illustrating a bracket included in each moment connection assembly of FIG. 7.

The bracket 200A includes a notch 210A (or cutoff or area of reduced thickness) at the top end thereof (when the bracket 200A is aligned as illustrated in FIG. 7). The notch 210A may be disposed adjacent to the face of the column 500A (or at the interface between the bracket 200A and the column 500A).

Figure 10:
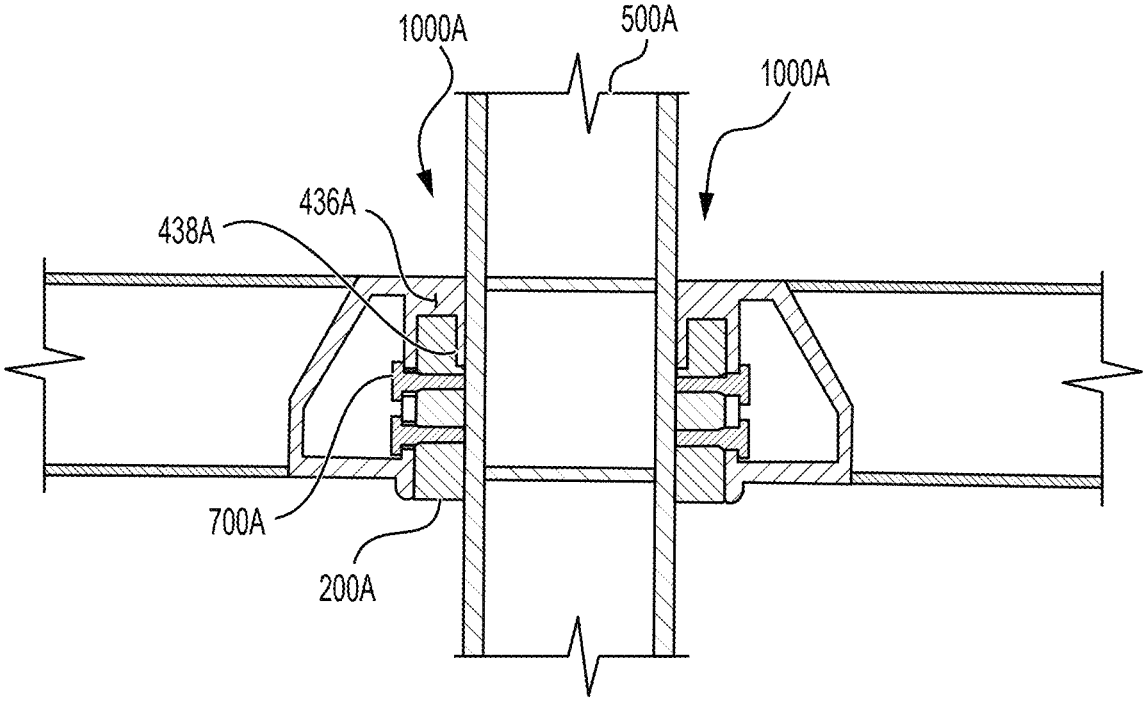
Figure 11:
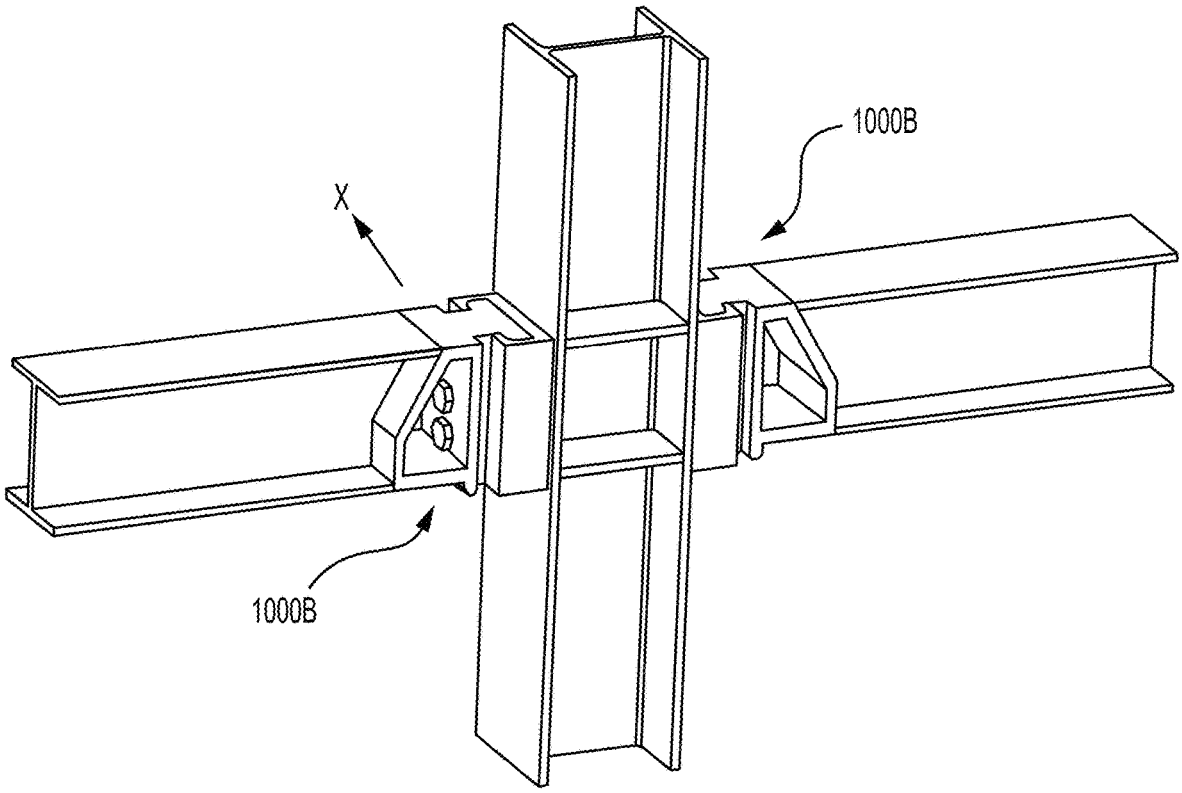
FIG. 11 is a perspective view illustrating a pair of moment connection assemblies in accordance with an embodiment of the subject matter.
Figure 12:
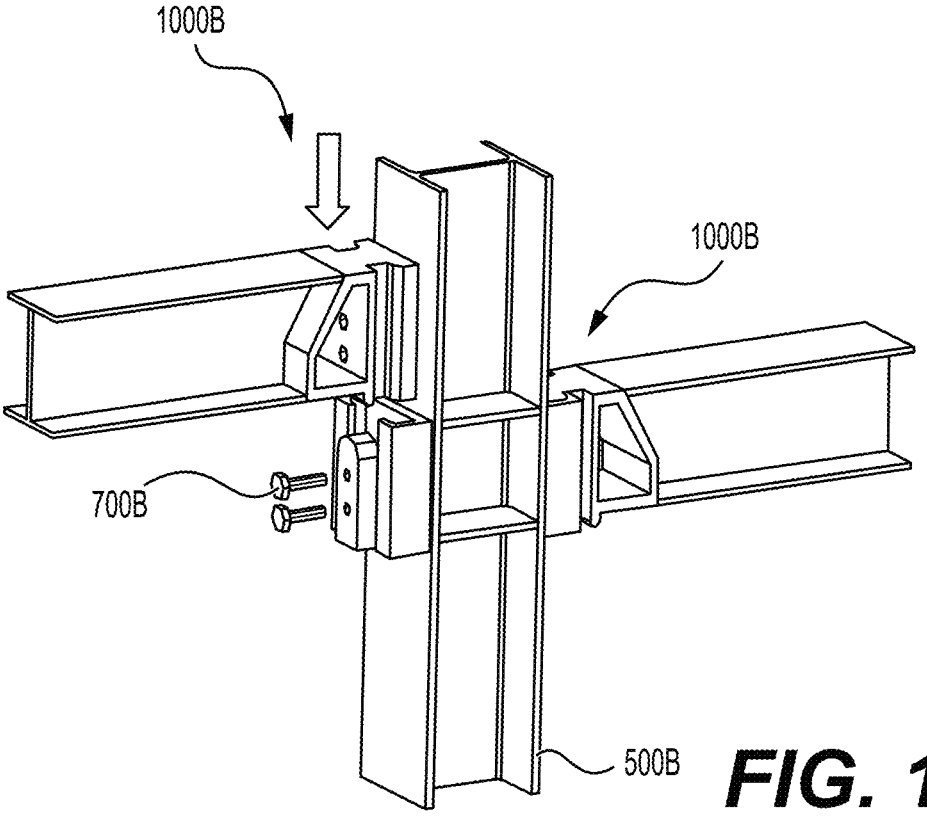
FIG. 12 is a perspective view illustrating the left-hand side moment connection assembly of FIG. 11 during installation.

The notch 210A is configured to receive the fourth bar 438A inside, as illustrated in the assembled state of FIG. 10, to provide a strong connection between the bracket and clamp 200A, 400A.

The assembly 1000A may also include first and second fasteners 700A, along with cavities in the bracket 200A and matching cavities in the first sidewall 422A for receiving and engaging the fasteners 700A therealong, as described for the assembly 1000.

However, the use of the fasteners 700A is optional in the assembly 1000A since the insertion of the fourth bar 438A in the notch 210A can resist an axial tensile force between the beam 600A and the column 500A. As such, the assembly 1000A may omit the fasteners 700 altogether.

FIGS. 11-16 illustrate an assembly 1000B that has a configuration generally similar to the configuration of the assembly 1000A but with additional structure defining a tongue-and-groove connection on either side of the bracket and clamp.

Referring to FIGS. 11-16, an assembly 1000B for a moment connection between first and second structural members 500B, 600B (e.g., a column 500B and a beam 600B) includes a bracket 200B and a clamp 400B. The bracket 200B and the clamp 400B are configured to be selectively connectable to one another.

The clamp 400B includes:

- a hollow structural member 420B extending in the first direction X (see FIGS. 14-15), similarly to the hollow structural members 420, 420B;
- a first bar 432B (see FIG. 15) protruding from a first sidewall 422B of the plurality of sidewalls of the hollow structural member 420B toward the bracket 200B, the first bar 432B extending in the second direction Y (e.g., downwardly) that intersects the first direction X;
- a second bar 434B (see FIG. 14) protruding from the first sidewall 422B (toward the bracket 200B) and extending in the second direction Y, the second bar 434B being spaced apart from the first bar 432B;
- a third bar 436B (see FIGS. 14-15) protruding from the first sidewall 422B (toward the bracket 200B) and extending in the first direction X, the third bar 436B connecting the first and second bars 432B, 434B to one another, the first to third bars 432B-436B defining a space therebetween;
- a first flange 450B protruding in the first direction X from the first bar 432B and extending in the second direction Y (e.g., downwardly); the first flange 450B, the first bar 432B and the first sidewall 422B of the hollow structural member 420B define a first groove 452B extending in the second direction Y; and
- a second flange 460B protruding in a direction opposite to the first direction X (that is, in a-X direction, see FIG. 15) from the second bar 434B and extending in the second direction Y; the second flange 460B, the second bar 434B and the first sidewall 422B of the hollow structural member 420B define a second groove 462B extending in the second direction Y.

The bracket 200B includes a bracket body 220B extending in the second direction Y (see FIG. 13) and a hollow component 240B connected to the bracket body 220B. The hollow component 240B is configured to be affixed to the first structural member 500 (i.e., the column 500B) by welding, bolting, etc.

Figure 13:
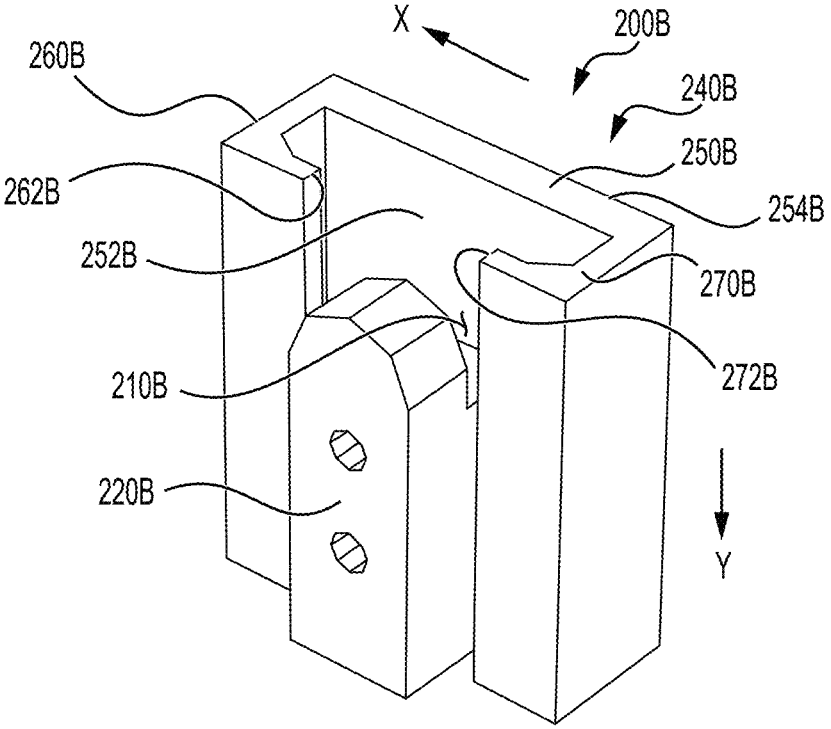
FIG. 13 is a perspective view illustrating a bracket included in each moment connection assembly of FIG. 11.

The hollow component 240B includes:

- a plate 250B having a width extending in the first direction X (see FIG. 13) and a length extending in the second direction Y (see FIG. 13); the bracket body 220B is connected to a first side surface 252B of the plate 250B; a second side surface 254B of the plate 250B, arranged opposite to the first side surface 252B, is configured to be connected to the first structural member 500B; and
- first and second L-shaped components 260B, 270B extending from the first side surface 252B of the plate 250B; the first and second L-shaped components 260B, 270B are spaced apart from one another and the bracket body 220B is arranged between the first and second L-shaped components 260B, 270B (the first and second L-shaped components 260B, 270B can be in a mirror arrangement with one another, as illustrated in FIG. 13). The first and second L-shaped components 260B, 270B may extend in the second direction Y and may be parallel to one another.

The first L-shaped component 260B defines a first tongue 262B. The first tongue 262B protrudes in the −X direction and extends in the second direction Y (e.g., downwardly). The second L-shaped component 270B defines a second tongue 272B. The second tongue 272B protrudes in the first direction X and extends in the second direction Y.

As can be gleaned with reference to FIGS. 11-16, when the bracket 200B and the clamp 400B are selectively connected to one another, the first tongue 262B extends in the first groove 452B, the second tongue 272B extends in the second groove 462B, and the bracket body 220 extends in the space defined by the first to third bars 432B-436B of the clamp 400.

The assembly 1000B may also include first and second fasteners 700B, along with cavities in the bracket body 220B and matching cavities in the first sidewall 422B for receiving and engaging the fasteners 700B therealong, as described for the assemblies 1000, 1000A.

The assembly 1000B may also include a notch and a fourth bar configured to be received in the notch, as described in this specification with reference to the assembly 1000A.

Referring to FIG. 13, the bracket body 220B may include a notch 210B at a first end thereof (e.g., at the top end of the first bracket body 220B). The clamp 400 may include a fourth bar 438B extending from the third bar 436B in a direction that crosses the direction in which the third bar extends (e.g., in the second direction Y, or downwardly). See FIG. 15. The notch 210B is configured to receive the fourth bar 438B inside when the clamp 400B and the bracket 200B are selectively connected to one another.

In an embodiment, as illustrated in FIGS. 7-18, a bracket 200C of an assembly 1000C may also include a toe plate 280C. The toe plate 280C may have an L-shape. The toe plate 280C may protrude from a first side surface 252C (in a third direction Z, toward a clamp 400C of the assembly 1000C) of a plate 250C. The plate 250C is a part of a hollow component 240C of the bracket 200C. The toe plate 280C may extend in the first direction X.

The third direction Z may cross the first and second directions X and Y. For example, the third direction Y may be orthogonal to the first and second directions X and Y.

The toe plate 280C is arranged with the toe of its L-shape pointing upwardly (in a-Y direction) to define a groove 282C. The groove 282C faces the bracket body 220C. Stated otherwise, the grove 282C is arranged proximate to bracket body 220C (or is located on the upper face of the toe plate 280C).

Figure 14:
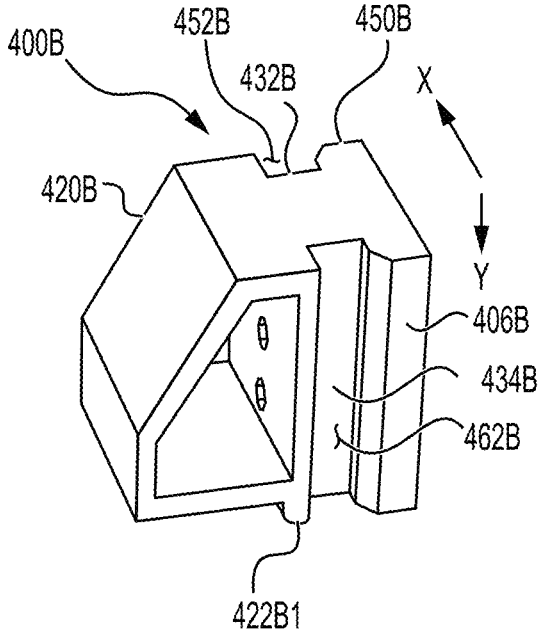
FIG. 14 is a perspective view illustrating a clamp included in each moment connection assembly of FIG. 11.
Figure 15:
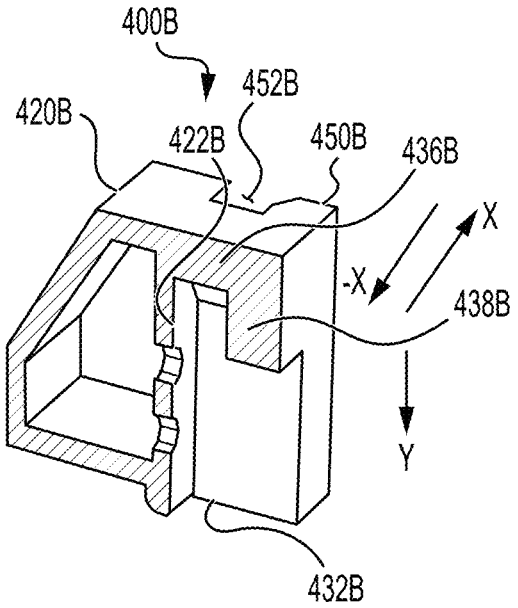
FIG. 15 is a perspective view illustrating the clamp of FIG. 14 cut vertically along its center.
Figure 16:
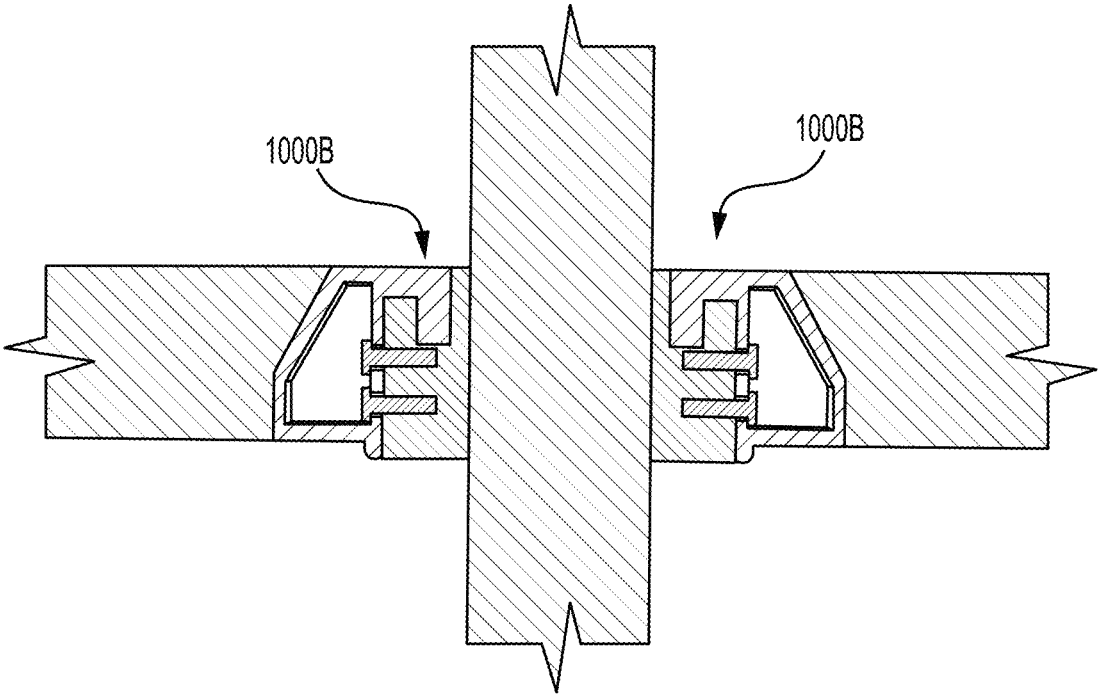
Figure 18:
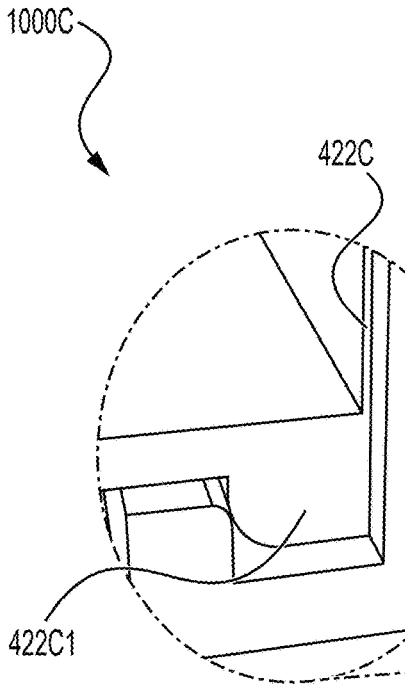
FIG. 18 is a partial perspective view illustrating a clamp of the moment connection assembly of FIG. 17 connected to the backet of FIG. 17.
Figure 17:
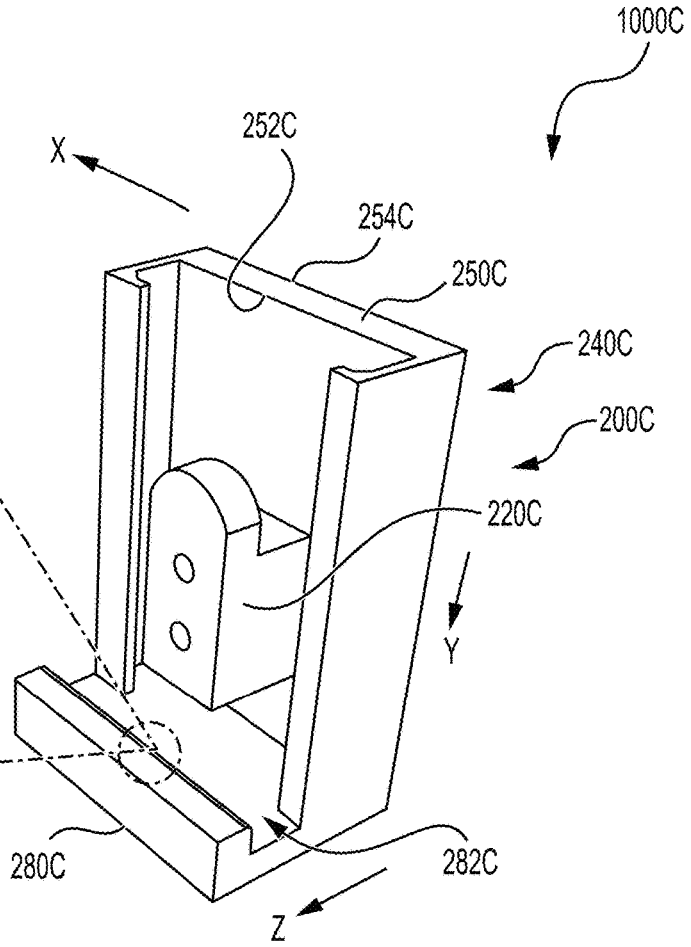
FIG. 17 is a perspective view illustrating a bracket of a moment connection assembly in accordance with an embodiment of the subject matter.
Figure 19:
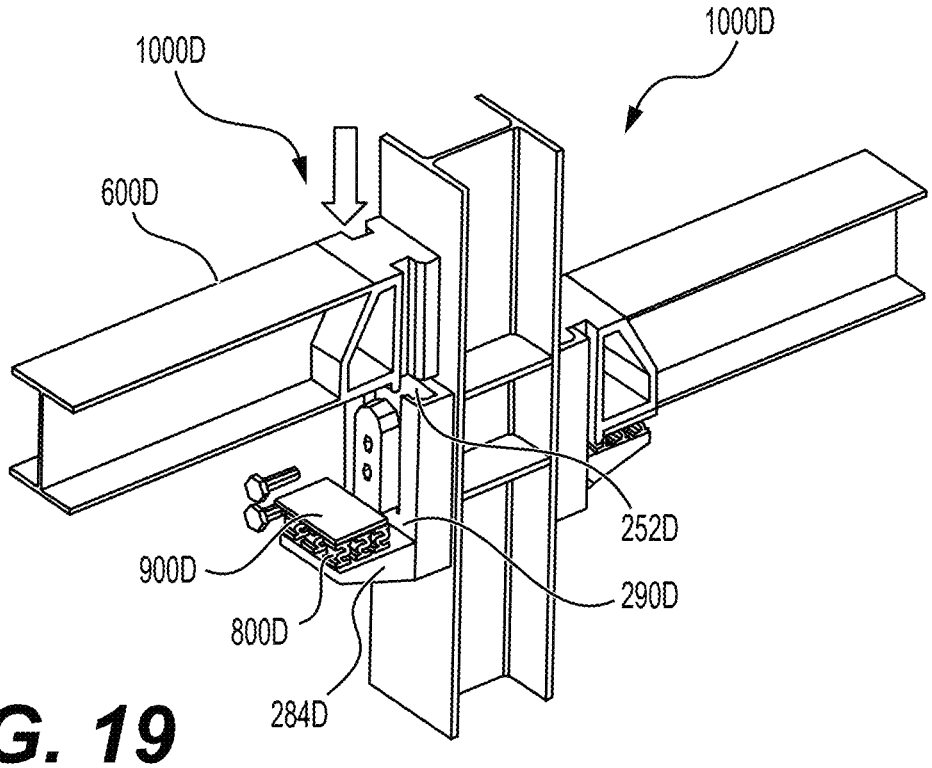
FIG. 19 is a perspective view illustrating moment connection assemblies in accordance with an embodiment of the subject matter.
Figure 20:
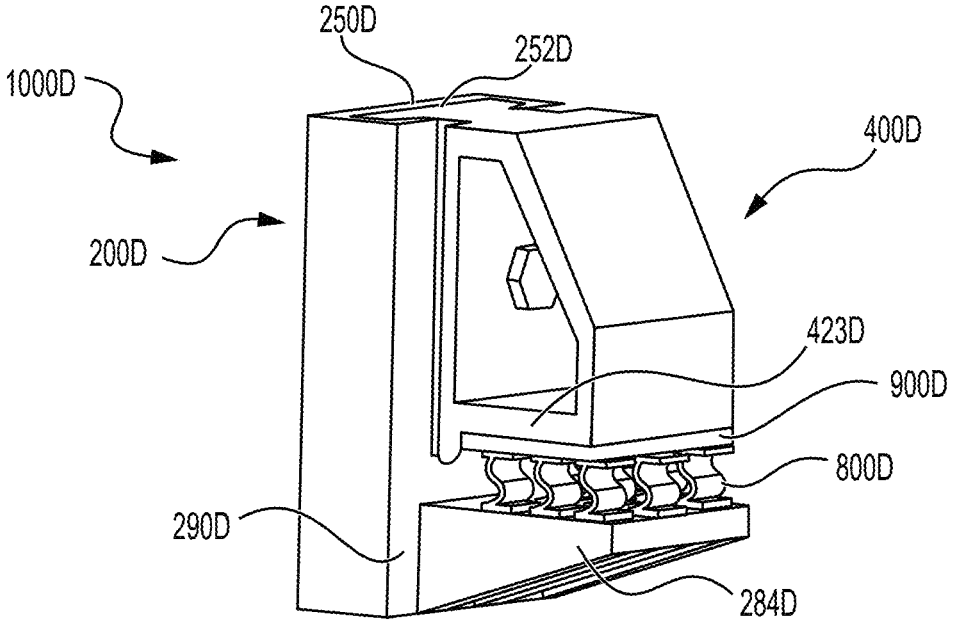
FIG. 20 is a perspective view illustrating one of the moment connection assemblies of FIG. 19 in isolation.

A portion 422C1 of a first sidewall 422C of a hollow structural member 400C of a clamp of the assembly 1000C—that protrudes (in the second direction Y) below the adjacent sidewall 423C (or bottom sidewall) of the hollow structural member 400C—is configured to be accommodated in the groove 282C when the clamp 400C is lowered on the bracket 200C to connect the bracket and clamp 200C, 400C to one another. See FIG. 18. Since FIG. 18. illustrates a partial view of the first sidewall 422C, a clearer view of a corresponding first sidewall 422B with its corresponding protruding portion 422B1 is illustrated in FIG. 14. The configuration of the assembly 1000C provides a strong connection between the bracket 200C and the clamp 400C.

All other aspects or components of the assembly 1000C not described in detail may be presumed to be the same as or similar to corresponding aspects or components of the assembly 1000B.

In an embodiment, and with reference to FIGS. 19-22, an assembly 1000D is similar to the assembly 1000B but includes a ledge 284D connected to a plate 250D and protruding from a plate 250D (e.g., from the first side surface 252D). The ledge 284D may extend (or protrude) from a structural portion 290D of the bracket 200D (the structural portion 290D being connected to the plate 250D), as illustrated in the drawings. Alternatively, the ledge 284D may extend directly from the plate 250D. The ledge 284D protrudes in the third direction Z and extends in the first direction Y.

The assembly 1000D may also include a plurality of dampers 800D and a plate 900D. When the assembly 1000D is constructed (i.e., when the bracket 200D is selectively slidably connected to the clamp 400D), the plurality of dampers 800D and the plate 900D are arranged between the clamp 400D and the ledge 284D.

The plurality of dampers 800D can be made of a metal, as described in this specification. The dampers 800D can be distributed across the surface area of the ledge 284D. For example, the dampers 800D can be arranged in an array of rows and columns. Alternatively, the dampers 800D can be arranged in a staggered formation. If desired, the dampers 800D can be arranged in an irregular formation.

Figure 21:
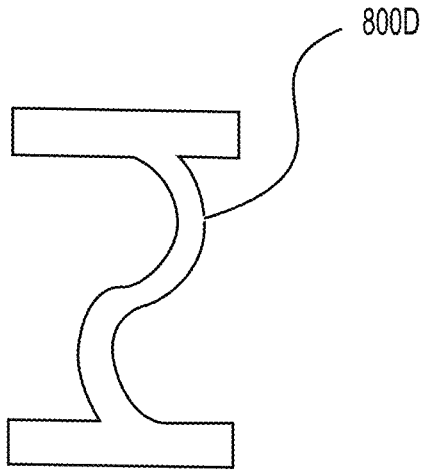
FIG. 21 is a side view illustrating a damper included in each of the moment connection assemblies of FIG. 19.

The dampers 800D may have an S-shape with a flange at the top and a flange at the bottom, as illustrated in FIG. 21. The dampers 800D may be flexed (e.g., compressed) from a compressive force coming downwardly from the clamp 400D (i.e., from the second sidewall 423D) when the structure that employs the assembly 1000D is subjected to earthquake loads. The dampers 800D, by way of their flexibility, in combination with the shape and configuration of the ledge 284D and the second sidewall 423D, increase the resistance to earthquake loads of the moment connection formed by the assembly 1000D.

Figure 22:
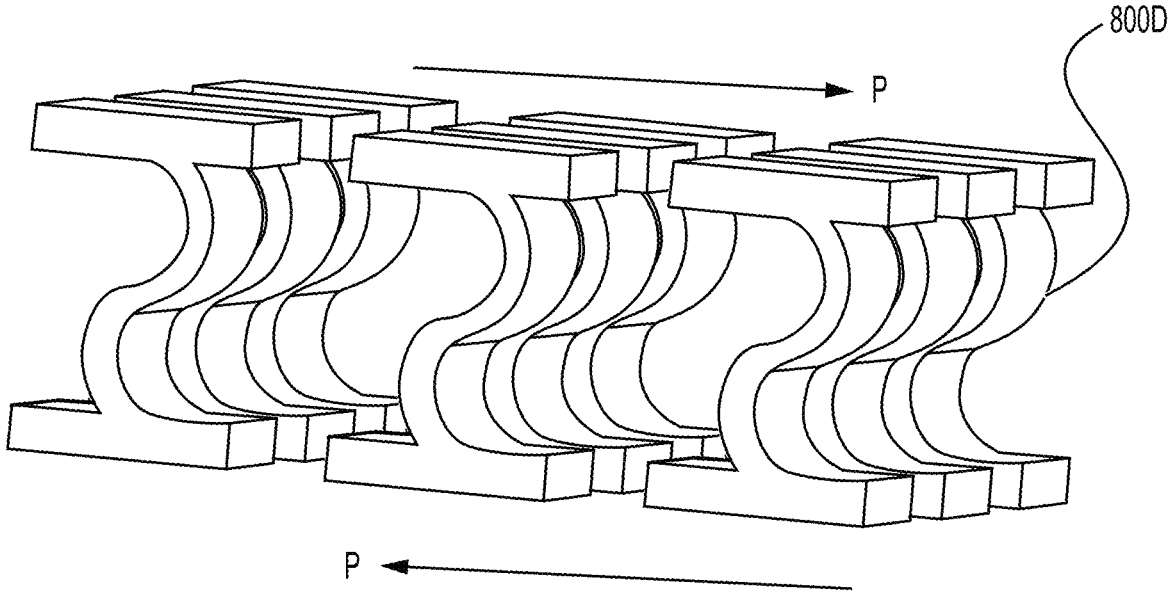
FIG. 22 is a perspective view illustrating a plurality of dampers included in each of the moment connection assemblies of FIG. 19 in isolation.

The S-shaped body of the dampers 800D in combination with the flanges at the top and bottom of each S-shaped body assists the dampers 800D in flexing downwardly and laterally (laterally in the third direction Z and in the −Z direction, as shown by the arrows "P" in FIG. 22, which is the length direction of the beam 600D) due to the compressive forces exerted thereon from the second sidewall 423D and due to longitudinal movement of the beam 600D in the directions Z and −Z) in response to an earthquake. This configuration increases the resistance of the assembly 1000D to earthquake loads.

The plate 900D may serve as a shim to close any gap that results between the clamp 400D and the tops (or top flanges) of the dampers 800D when the assembly 1000D is constructed. The plate 900D may be omitted when no gap between the dampers 800D and the clamp 400D results at the time the assembly 1000D is constructed.

The assembly 1000D is suitable for use in metallic structures built in active seismic zones due to its high resistance to earthquake loads.

All features/components of the assembly 1000D not described in detail herein may be assumed to be the same as or similar to corresponding features/components of a moment connection assembly described in this specification.

A metallic structure can be constructed with one or more moment connection assemblies as described in this specification to reduce the construction time and the construction cost while providing strong connections between the beams and columns of the structure.

In another embodiment, the present subject matter relates to a method for producing a moment connection in a metallic frame, wherein the method includes:

providing a bracket, as described in this specification;
affixing the bracket to a metallic column;
providing a clamp, as described in this specification;
affixing the clamp to an end of a metallic beam; and
slidably engaging the bracket and the clamp to one another along their respective lengths.

The slidable engagement between the bracket and the clamp enables gravitational loads (e.g., shear force), a bending moment and axial load (axial relative to an axis in which the beam extends) to be transferred from the beam to the column.

The slidable engagement of the bracket to the clamp may include raising the clamp (e.g., raising the entire beam with the clamp) above the elevation of the bracket, and then lowering the clamp onto the bracket to insert the bracket in the space defined by the first to third bars (e.g., the first-third bars 432, 434, 436 of the assembly 1000 or their equivalents in the assemblies 1000A-1000D).

While the present disclosure has been particularly shown and described with reference to exemplary embodiments thereof, it will be apparent to those of ordinary skill in the art that various changes in form and detail may be made therein without departing from the spirit and scope of the present disclosure as defined by the following claims.

What is claimed is:

1. An assembly for a moment connection between first and second structural members, the assembly comprising:

a bracket having an elongated body and configured to be connected to the first structural member; and a clamp configured to be connected to the second structural member, wherein the clamp includes:

a hollow structural member extending in a first direction, the hollow structural member including a plurality of sidewalls connected to one another and defining a cavity of the hollow structural member in the first direction;

a first bar protruding from a first sidewall of the plurality of sidewalls of the hollow structural member, the first bar extending in a second direction that intersects the first direction, the first sidewall of the hollow structural member being arranged between the cavity of the hollow structural member and the first bar;

a second bar protruding from said first sidewall and extending in the second direction, the second bar being spaced apart from the first bar, the first sidewall of the hollow structural member being arranged between the cavity of the hollow structural member and the second bar; and a third bar protruding from said first sidewall and extending in the first direction, the first sidewall of the hollow structural member being arranged between the cavity of the hollow structural member and the third bar, the third bar connecting the first and second bars to one another such that the first to third bars define a space configured to selectively receive the elongated body of the bracket therealong to selectively connect the bracket and the clamp to one another.

2. The assembly of claim 1, wherein the first sidewall of the plurality of sidewalls of the hollow structural member includes a first cavity and the elongated body of the bracket includes a first cavity, wherein, the first cavity of the first sidewall and the first cavity of the elongated body of the bracket are configured to be aligned with one another when the elongated body of bracket is selectively received in the space defined by the clamp.

3. The assembly of claim 2, further comprising a first fastener, the first fastener being configured to be engageably received in the first cavity of the first sidewall and in the first cavity of the elongated body of the bracket to connect the bracket and the clamp to one another.

4. The assembly of claim 3, wherein the first fastener is a bolt, and the first cavities of the first sidewall and the elongated body of the bracket, respectively, have threads matching threads of the bolt.

5. The assembly of claim 2, wherein the first sidewall of the plurality of sidewalls of the hollow structural member further includes a second cavity spaced apart from the first cavity thereof, and the elongated body of the bracket further includes a second cavity spaced apart from the first cavity thereof, wherein, the second cavity of the first sidewall and the second cavity of the elongated body of the bracket are configured to be aligned with one another when the elongated body of bracket is selectively received in the space defined by the clamp, the assembly further comprising a second fastener, the second fastener being configured to be engageably received in the second cavity of the first sidewall and in the second cavity of the elongated body of the bracket to connect the bracket and the clamp to one another.

6. The assembly of claim 1, wherein the clamp further includes a fourth bar extending from the third bar, the fourth bar extending at a direction that crosses the direction in which the third bar extends, and wherein the elongated body of the bracket further includes a notch, wherein the notch is configured to receive the fourth bar therein when the clamp and the bracket are selectively connected to one another.

7. A method for producing a moment connection in a metallic frame, the method comprising:

providing a bracket;

affixing the bracket to a metallic column;

providing a clamp;

affixing the clamp to an end of a metallic beam; and slidably engaging the bracket and the clamp to one another along their respective lengths, wherein the step of slidably engaging the bracket and the clamp to one another includes raising the clamp above an elevation of the bracket and lowering the clamp onto the bracket to engage the bracket and the clamp to one another, wherein the slidable engagement between the bracket and the clamp enables gravitational loads, a bending moment and/or axial load to be transferred from the beam to the column, wherein the bracket has an elongated body and is configured to be connected to the first structural member;

wherein the clamp includes:

a hollow structural member extending in a first direction, the hollow structural member including a plurality of sidewalls connected to one another and defining a cavity of the hollow structural member in the first direction;

a first bar protruding from a first sidewall of the plurality of sidewalls of the hollow structural member, the first bar extending in a second direction that intersects the first direction, the first sidewall of the hollow structural member being arranged between the cavity of the hollow structural member and the first bar;

a second bar protruding from said first sidewall and extending in the second direction, the second bar being spaced apart from the first bar, the first sidewall of the hollow structural member being arranged between the cavity of the hollow structural member and the second bar; and a third bar protruding from said first sidewall and extending in the first direction, the first sidewall of the hollow structural member being arranged between the cavity of the hollow structural member and the third bar, the third bar connecting the first and second bars to one another such that the first to third bars define a space configured to selectively receive the elongated body of the bracket therealong to selectively connect the bracket and the clamp to one another, wherein the step of slidably engaging the bracket and the clamp to one another includes inserting the elongated body of the bracket in the space defined by the first to third bars.

8. The method of claim 7, wherein the assembly further includes a plurality of dampers, wherein the bracket further includes a ledge protruding from the first side surface of the plate, and wherein, when the bracket and clamp are selectively connected to one another, the plurality of dampers is arranged between the ledge and a second sidewall of the hollow structural member of the clamp.

* * * * *